US005613889A

United States Patent [19]

Nosker et al.

[11] Patent Number: 5,613,889

[45] Date of Patent: Mar. 25, 1997

[54] METHOD OF MAKING A TENSIONED FOCUS MASK

[76] Inventors: Richard W. Nosker, 269 Hawthorne Ave., Princeton, N.J. 08540; Joey J. Michalchuk, 28 Rocktown-Lamb. Rd., Lambertville, N.J. 08530; Paul Kuczer, 90 Taylor Dr., Fallsington, Pa. 19054; Elmer W. Hodge, 101 St. Thomas Rd., Lancaster, Pa. 17601

[21] Appl. No.: 507,769

[22] Filed: Jul. 26, 1995

[51] Int. Cl.[6] ..... H01J 9/14

[52] U.S. Cl. ..... 445/37

[58] Field of Search ..... 445/67, 68, 37

[56] References Cited

U.S. PATENT DOCUMENTS

| | | | |
|---|---|---|---|
| 2,999,300 | 9/1961 | Sandor | 29/25.19 |
| 3,357,459 | 12/1967 | Cahen et al. | 140/71.5 |
| 3,722,044 | 3/1973 | Law | 29/25.16 |
| 4,470,822 | 9/1984 | Bloom et al. | 445/37 X |

*Primary Examiner*—Kenneth J. Ramsey

*Attorney, Agent, or Firm*—Joseph S. Tripoli; Dennis H. Irlbeck

[57] ABSTRACT

The present invention provides a method of making a tensioned focus mask. Such a mask includes a set of parallel strands and a set of parallel wires that are perpendicular to the strands and separated from the strands by insulator means. The method includes attaching the strands to a mask frame and then coating the strands with a first insulator. The first insulator is then cured, and a second insulator is applied to the first insulator. Next, wires are wound over and in contact with the second insulator, by rotating the mask frame and by drawing a continuous wire from a source through a tensioner, while guiding the continuous wire into desired positions overlying the strands. Finally, the second insulator is heated until the wires attach to the second insulator.

5 Claims, 4 Drawing Sheets

METHOD OF MAKING A TENSIONED FOCUS MASK

This invention relates to masks for use in color picture tubes, and particularly to a method of assembling a tensioned focus mask that includes perpendicular sets of strands and wires.

BACKGROUND OF THE INVENTION

A color picture tube includes an electron gun for forming and directing three electron beams to a screen of the tube. The screen is located on the inner surface of a faceplate of the tube and is made up of an array of elements of three different color emitting phosphors. An apertured mask, which may be either a shadow mask or a focus mask, is interposed between the gun and the screen to permit each electron beam to strike only the phosphor elements associated with that beam. A shadow mask is a thin sheet of metal, such as steel, that is contoured to somewhat parallel the inner surface of the tube faceplate. A shadow mask may be either domed or tensioned. A focus mask comprises two sets of conductive lines that are perpendicular to each other and separated by an insulator. Different voltages are applied to the two sets to create multipole focusing lenses in each of the mask openings. One type of focus mask is a tensioned focus mask, wherein at least one of the sets of conductive lines is under tension. Generally, in a tensioned focus mask, a vertical set of conductive lines or strands is under tension and a horizontal set of conductive lines or wires overlies the strands.

In assembling a tensioned focus mask, it is required to assemble the wires and strands with a high degree of accuracy to achieve consistent spacing. If the spacing precision can be maintained well enough, new manufacturing methods can be used for making the screens of tubes. For example, if, in general, a mask can be made repetitively precise enough, the matrix and phosphor patterns of a screen could be preprinted without using a particular mask as a photomaster. It is therefore desirable to develop techniques for assembling tensioned focus masks that will provide the precision that is required for the new manufacturing methods.

SUMMARY OF THE INVENTION

The present invention provides a method of making a tensioned focus mask. Such a mask includes a set of parallel strands and a set of parallel wires that are perpendicular to the strands and separated from the strands by insulator means. The method includes attaching the strands to a mask frame and then coating the strands with a first insulator. The first insulator is then cured, and a second insulator is applied to the first insulator. Next, wires are wound over and in contact with the second insulator, by rotating the mask frame and by drawing a continuous wire from a source through a tensioner, while guiding the continuous wire into desired positions overlying the strands. Finally, the second insulator is heated until the wires attach to the second insulator.

DETAILED DESCRIPTION OF THE PREFERRED EMBODIMENTS

Figure 1:
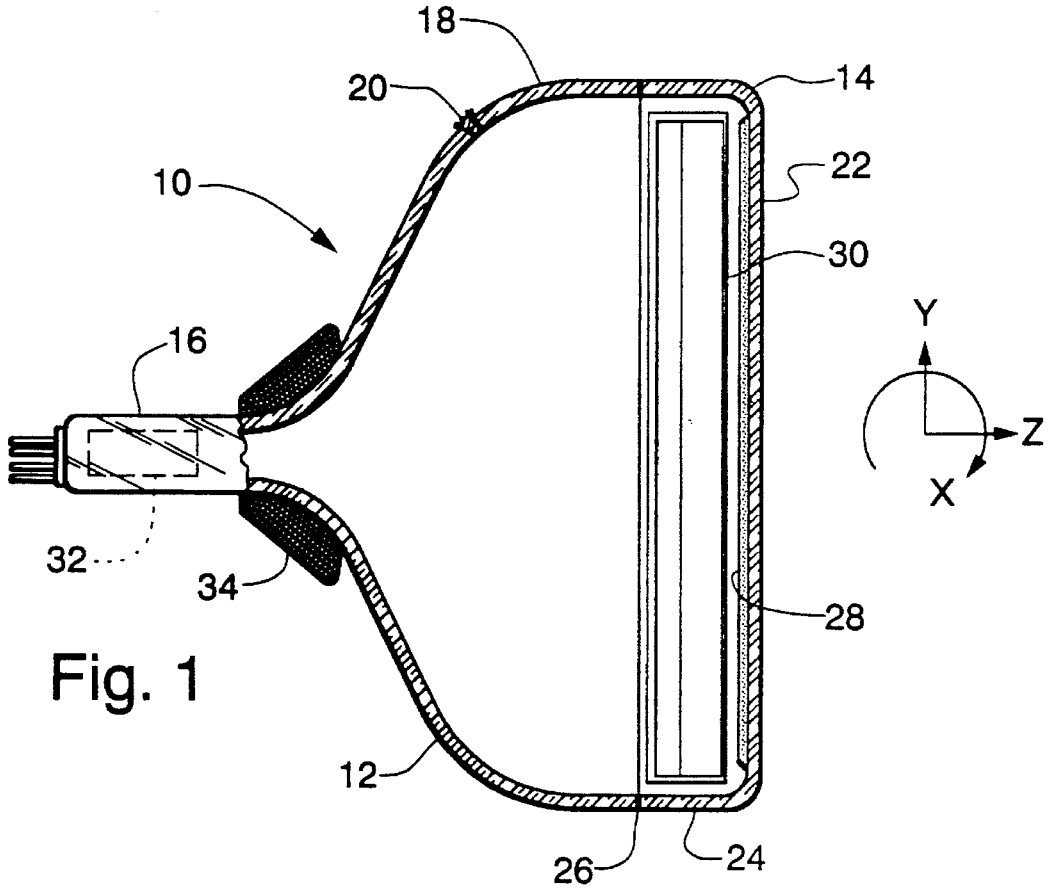
FIG. 1 is a side view, partly in axial section, of a color picture tube including a tensioned focus mask-frame-assembly mask according to the present invention.

FIG. 1 shows a cathode-ray tube 10 having a glass envelope 12 comprising a rectangular faceplate panel 14 and a tubular neck 16 connected by a rectangular funnel 18. The funnel 18 has an internal conductive coating (not shown) that extends from an anode button 20 to the neck 16. The panel 14 comprises a cylindrical viewing faceplate 22 and a peripheral flange or sidewall 24 which is sealed to the funnel 18 by a glass frit 26. A three-color phosphor screen 28 is carried by the inner surface of the faceplate 22. The screen 28 is a line screen with the phosphor lines arranged in triads, each triad including a phosphor line of each of the three colors. A cylindrical tensioned focus mask 30 is removably mounted in predetermined spaced relation to the screen 28. An electron gun 32, shown schematically by dashed lines in FIG. 1, is centrally mounted within the neck 16 to generate and direct three inline electron beams, a center beam and two side beams, along convergent paths through the mask 30 to the screen 28.

The tube 10 is designed to be used with an external magnetic deflection yoke, such as the yoke 34 shown in the neighborhood of the funnel-to-neck junction. When activated, the yoke 34 subjects the three beams to magnetic fields which cause the beams to scan horizontally and vertically in a rectangular raster over the screen 28.

Figure 2:
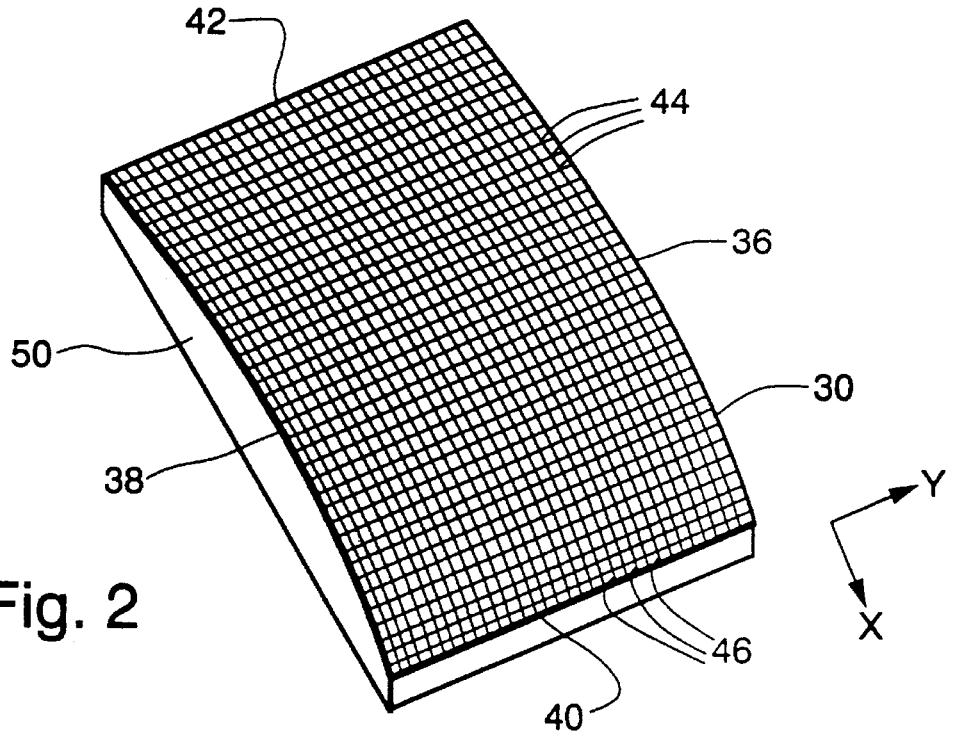
FIG. 2 is a perspective view of the tensioned focus mask-frame assembly of FIG. 1.

The tensioned focus mask 30, shown in greater detail in FIG. 2, includes two long sides 36 and 38 and two short sides 40 and 42. The two long sides 36 and 38 of the mask parallel a central major axis, X, of the mask, and the two short sides 40 and 42 parallel a central minor axis, Y, of the tube. The tensioned focus mask 30 includes two sets of conductive lines: strands 44, that are parallel to the central minor axis Y and to each other; and wires 46, that are parallel to the central major axis X and to each other. In a preferred embodiment, the strands 44 are flat strips that extend vertically, and the wires 46 have a round cross-section and extend horizontally. In the completed mask, the strands and wires are separated from each other by suitable insulators.

Figure 3:
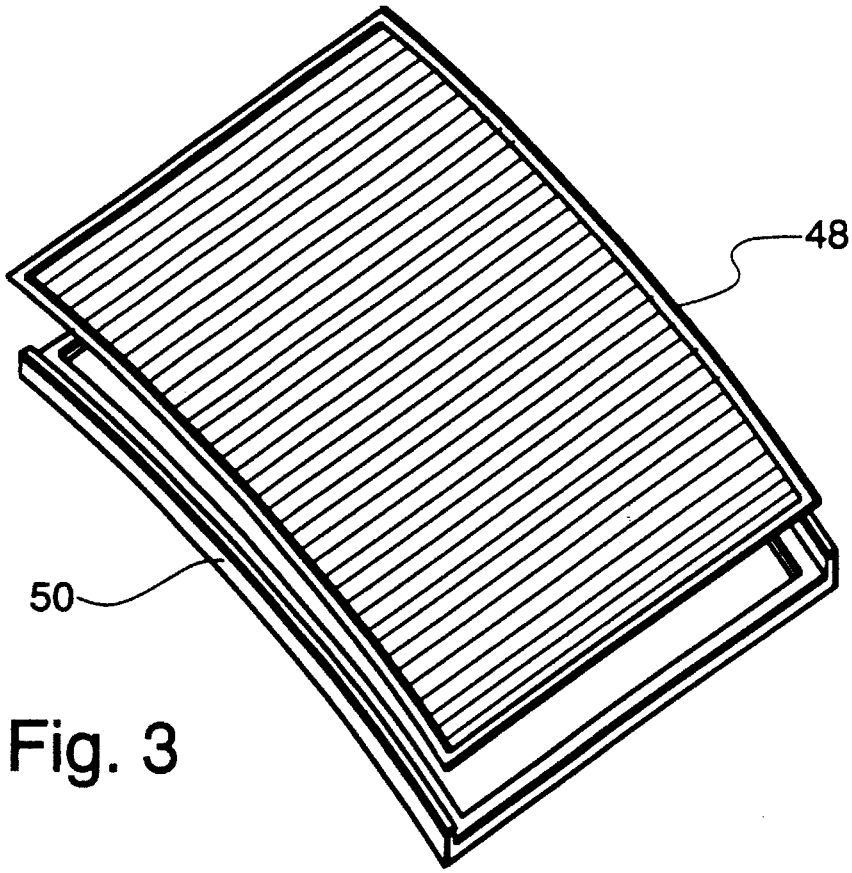
FIG. 3 is a perspective view of a focus mask assembly during application of an etched mask containing parallel strands.
Figure 4:
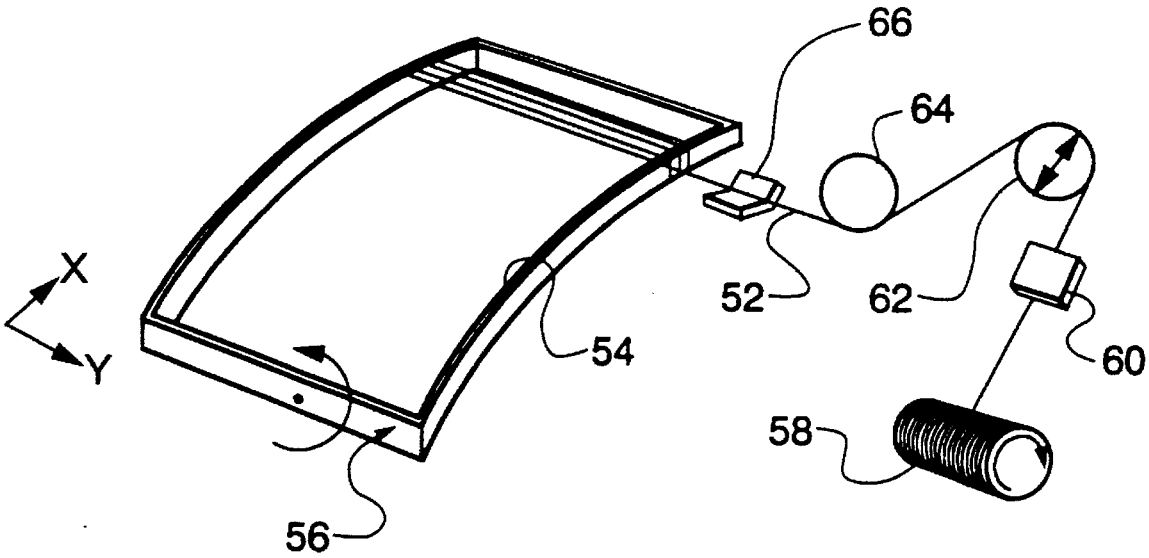
FIG. 4 is a perspective view of a focus mask assembly during application of parallel strands by a winding technique.

The strands 44 may be either part of an etched mask or individual elements. FIG. 3 shows an etched mask 48 positioned above a mask frame 50 prior to attachment of the mask to the frame. The etched mask 48 incorporates parallel strands in a single structure. FIG. 4 shows a continuous strand 52 being applied to a mask frame 54 that is held in a holding and preload device 56. The device 56 applies pressure to the mask frame 54 to slightly reduce the distance between the long sides of the frame. The holding and preload device 56 and the frame 54 are rotatable about the major axis X of the frame. The continuous strand 52 is provided from a spool 58. After exiting the spool 58, the strand 52 passes through a friction pad 60 that sets the winding tension of the strand. Next, the strand 52 passes around a moving arm 62 that maintains a constant strand feed rate. The continuous strand 52 then passes around another guide 64 and through a guide notch 66, before being wrapped around the frame 54 and device 56 by the rotation of both about the major axis X. After the continuous strand 52 has been wound around the frame 54, it is welded to the frame and the portions of the continuous strand that pass around the back of the frame are removed. Alternatively, several strands can be applied simultaneously to the frame from several spools.

Figure 5:
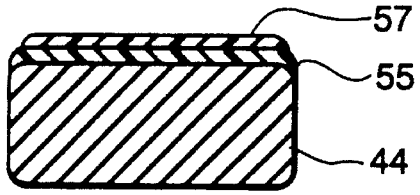
FIG. 5 is a cross-sectional view of a strand having insulating means thereon.

The upper or outer surfaces of the etched mask of FIG. 3 or the individual strands of FIG. 4 are coated with a first insulator 55, as shown in FIG. 5. The first insulator 55 is then cured, and a second insulator 57 is applied to the first insulator. The purpose of the first insulator 55 is to effect and maintain electrical separation between the strands and wires to be subsequently applied. The main purpose of the second insulator 57 is to bond such wires to the strands. Alternatively, either one or both insulators could be applied to the strands before the strands are attached to the frame.

Figure 6:
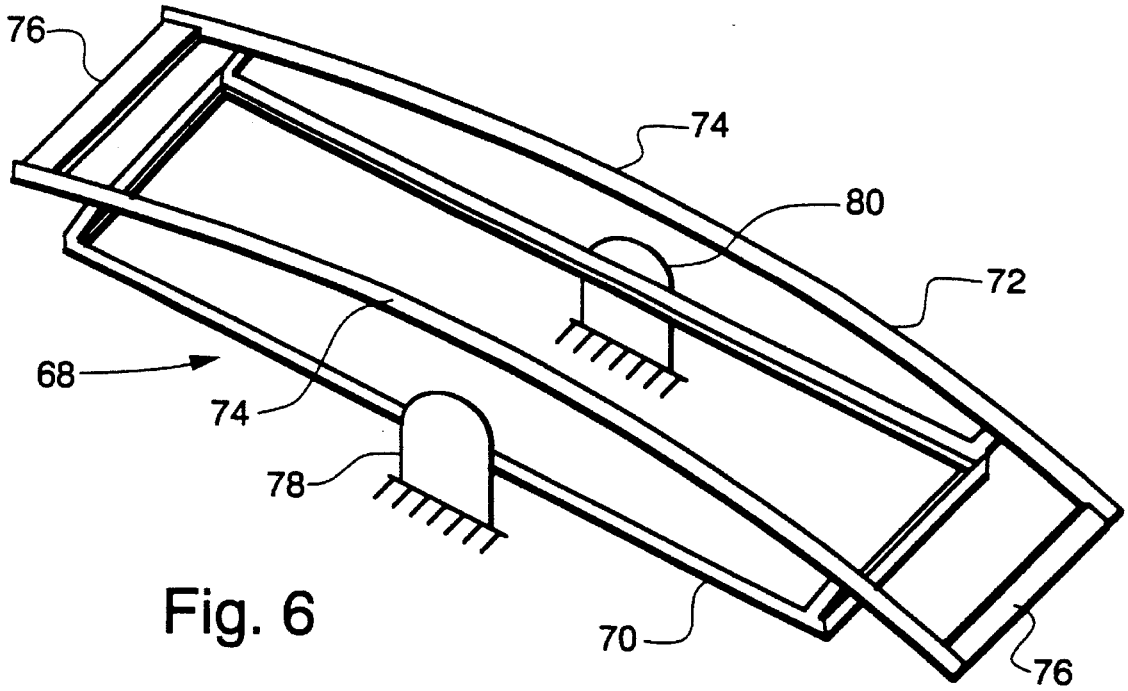
FIG. 6 is a perspective view of a rotatable device for holding a tension focus mask frame during application of parallel wires over strands on the frame.

Next, wires are wound over and in contact with the second insulator. FIG. 6 shows a rotatable device 68 for holding a tension mask frame during winding of wires over the previously attached strands. The device includes two rectangular sections, 70 and 72. The four sides of the section 70 have L-shaped cross-sections, positioned so that a frame can rest on the lower flanges of the sides. The section 72 has two curved sides 74 and two straight sides 76. The device 68 is rotated about two pivots 78 and 80 to wind a continuous wire over the strands of a mask and around the straight sides 76 of the device 68.

Figure 7:
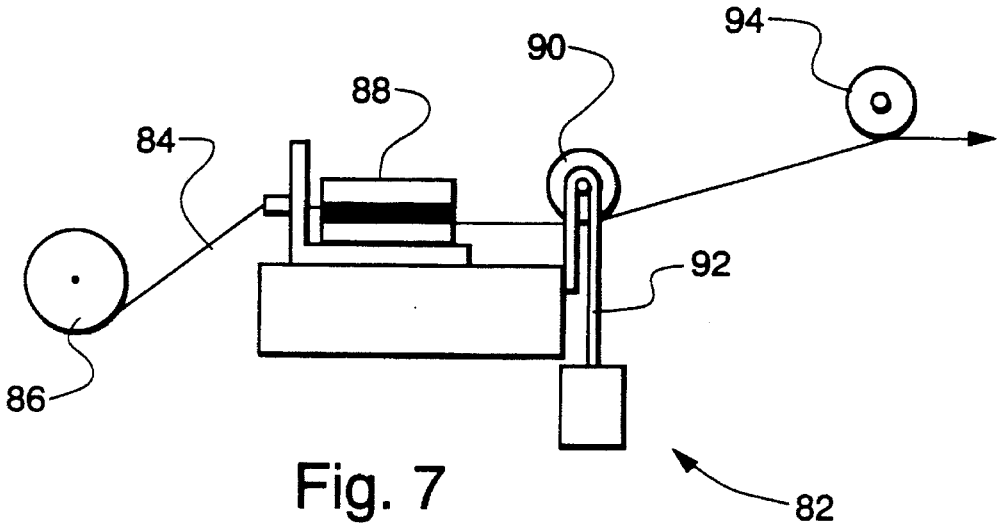
FIG. 7 is a side view of a winding fixture pretension system used for supplying wire to the device of FIG. 6.

A winding fixture pretension system 82, for providing a wire to the device 68, is shown in FIG. 7. A continuous wire 84 from a source or spool 86 first passes between weighted felt-lined plates 88 that pretension the wire. Then, the wire 84 passes around a tensioning roller 90, two times. The tensioning roller 90 is weighted by a felt tensioner 92 that passes over the shaft of the roller 90. The wire 84 next passes once around a V-shaped roller 94 that guides the wire over the strands on a mask frame that is held in the device 68. The pretension system 82 moves along a lead screw (not shown) that is timed to the rotation of the mask frame, to obtain the desired wire pitch.

Figure 8:
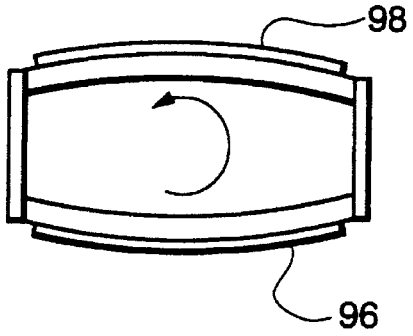
FIG. 8 is a schematic side view showing a positioning of two holding fixtures for simultaneous winding.
Figure 9:
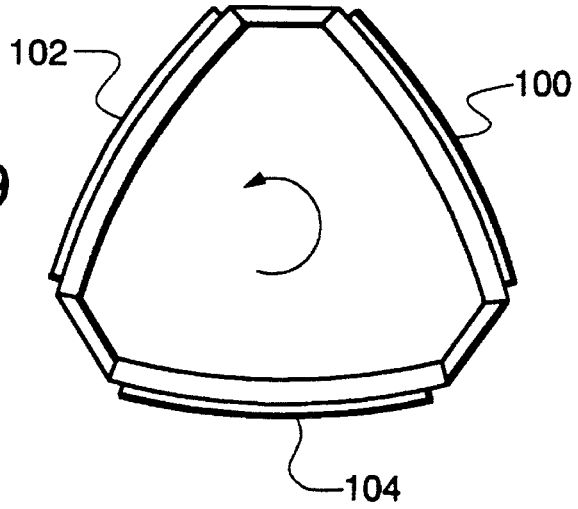
FIG. 9 is a schematic side view showing a positioning of three holding fixtures for simultaneous winding.
Figure 10:
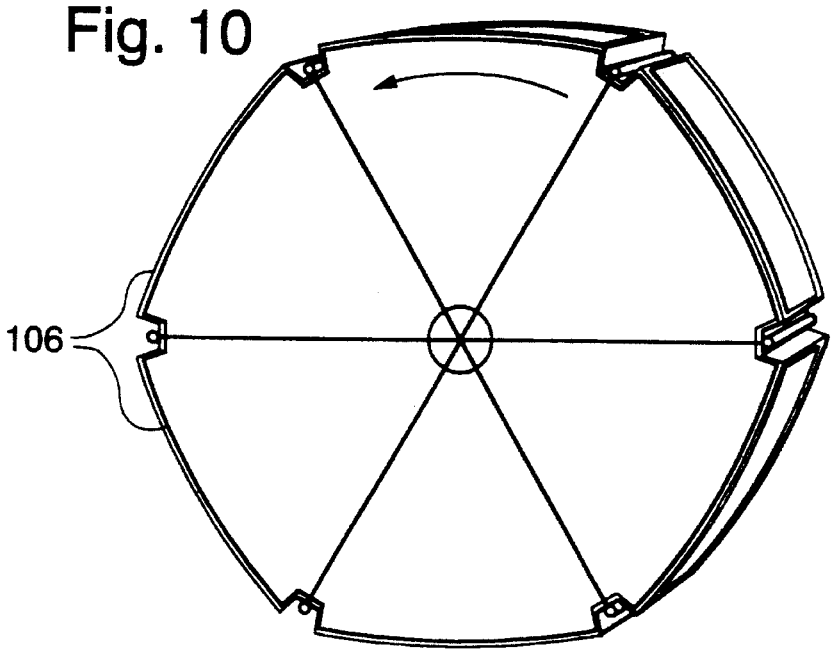
FIG. 10 is a perspective view showing a positioning of six holding fixtures for simultaneous winding.

FIG. 8 shows the positioning of two frames 96 and 98 for simultaneous application of wires to both. Similarly, FIG. 9 shows the positioning of three frames 100, 102 and 104 for simultaneous application of wires to the three frames. FIG. 10 shows the positioning of six frames 106 for simultaneous application of wires to the six frames.

Following application of the wires over the coated strands, the frame or frames and associated holding devices are placed into ovens to cure the second insulator, thereby binding the wires to the strands through the two insulators. Following curing, excess wire is removed and the frames are taken out of the holding devices. Thereafter, electrical connections are made to the strands and wires, and the tensioned focus mask is inserted into a tube envelope.

What is claimed is:

1. A method of making a tensioned focus mask, wherein said mask includes a set of parallel strands and a set of parallel wires that are perpendicular to said strands and separated from said strands by insulating means, said method including a) attaching said strands to a mask frame, b) coating said strands with a first insulator, c) curing said first insulator, d) coating said first insulator on said strands with a second insulator, e) winding said wires over and in contact with said second insulator, by rotating said mask frame and drawing a continuous wire from a source through a tensioner, while guiding said continuous wire into desired positions on said strands, and f) heating said second insulator until said wires attach to said second insulator.

2. The method as defined in claim 1, wherein said strands are parts of an etched mask.

3. The method as defined in claim 1, wherein said strands are wound onto said mask frame, from a source of continuous strand material, by rotating said mask frame.

4. The method as defined in claim 3, wherein prior to attaching said strands to said mask frame, portions of the frame to which strands will be attached are preloaded toward each other to reduce the spacing between these portions at the time said strands are attached to said mask frame.

5. The method as defined in claim 1, wherein step b) occurs before step a).

* * * * *